US009075340B2

(12) United States Patent
Kuroda et al.

(10) Patent No.: US 9,075,340 B2
(45) Date of Patent: Jul. 7, 2015

(54) DEVELOPING ROLLER

(75) Inventors: Kenichi Kuroda, Kobe (JP); Akihiko Kawatani, Kobe (JP); Yoshihisa Mizumoto, Kobe (JP)

(73) Assignee: SUMITOMO RUBBER INDUSTRIES, LTD., Kobe-shi (JP)

( * ) Notice: Subject to any disclaimer, the term of this patent is extended or adjusted under 35 U.S.C. 154(b) by 421 days.

(21) Appl. No.: 13/494,696

(22) Filed: Jun. 12, 2012

(65) Prior Publication Data

US 2013/0051870 A1 Feb. 28, 2013

(30) Foreign Application Priority Data

Aug. 22, 2011 (JP) ..... 2011-180882
Nov. 25, 2011 (JP) ..... 2011-258012

(51) Int. Cl.
*G03G 15/08* (2006.01)
*G03G 13/20* (2006.01)

(52) U.S. Cl.
CPC ..... *G03G 15/0818* (2013.01); *G03G 13/20* (2013.01); *G03G 2215/0861* (2013.01)

(58) Field of Classification Search
CPC ..... G03G 15/0818; G03G 13/20; G03G 2215/0861
USPC ..... 399/286; 492/56
See application file for complete search history.

(56) References Cited

U.S. PATENT DOCUMENTS 5,557,358 A 9/1996 Mukai et al.
5,733,235 A * 3/1998 Waku et al. ..... 492/25
2005/0207800 A1* 9/2005 Yamaguchi et al. ..... 399/302
2007/0254792 A1* 11/2007 Mizumoto ..... 492/53
2008/0107456 A1* 5/2008 Mizumoto et al. ..... 399/286
2009/0046567 A1 2/2009 Hisada et al.
2009/0060602 A1* 3/2009 Yamaguchi et al. ..... 399/350
2012/0202663 A1 8/2012 Mizumoto et al.

FOREIGN PATENT DOCUMENTS

JP 5-107604 A 4/1993
JP 8-292640 A 11/1996
JP 10-254215 A 9/1998
JP 2000-338778 A 12/2000
JP 2001-255737 A 9/2001
JP 2002-226711 A 8/2002
JP 3768243 B1 4/2006
JP 2007-164082 A 6/2007
JP 2007-316524 A 12/2007
JP 2008-145885 A 6/2008
JP 2009-150949 A 7/2009
JP 2011-154122 A 8/2011
JP 2012-163776 A 8/2012

* cited by examiner

*Primary Examiner* — Jacob Cigna

(74) *Attorney, Agent, or Firm* — Birch, Stewart, Kolasch & Birch, LLP

(57) ABSTRACT

An inventive developing roller is adapted for use in an electrophotographic image forming apparatus. The developing roller includes a roller body. At least an outer peripheral surface of the roller body is formed from a rubber composition containing a base rubber. The base rubber contains a styrene butadiene rubber in a proportion of not less than 10 mass % and not greater than 70 mass % based on the overall amount of the base rubber. The outer peripheral surface of the rubber body has a surface roughness Ra of not less than 0.78 μm and not greater than 1.8 μm.

10 Claims, 1 Drawing Sheet

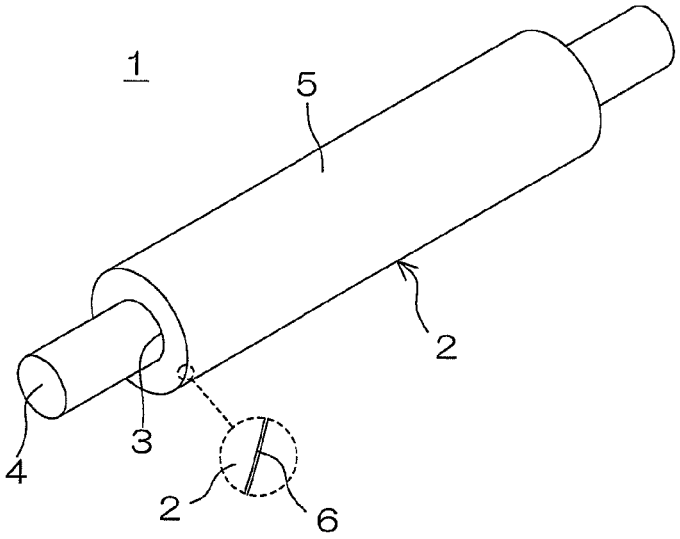
1
5
2
4
3
2
6

DEVELOPING ROLLER

BACKGROUND OF THE INVENTION

1. Field of the Invention

The present invention relates to a developing roller for use in an electrophotographic image forming apparatus. Examples of the image forming apparatus include laser printers, electrostatic copying machines, plain paper facsimile machines and printer-copier-facsimile multifunction machines.

2. Description of Related Art

In the various electrophotographic image forming apparatuses described above, a developing roller and a charging blade (layer regulating blade) kept in press contact with an outer peripheral surface of the developing roller are used for developing an electrostatic latent image formed by exposing a surface of an electrically charged photoreceptor drum into a toner image.

That is, when the developing roller is rotated in press contact with the charging blade, toner is electrically charged. Then, the electrically charged toner adheres to the outer peripheral surface of the developing roller, and the amount of the toner adhering to the outer peripheral surface is regulated by the charging blade. Thus, a toner layer having a generally even thickness is formed on the generally entire outer peripheral surface of the developing roller.

In this state, the developing roller is further rotated to transport the toner layer to the vicinity of the surface of the photoreceptor drum. Then, the toner of the toner layer is selectively transferred onto the surface of the photoreceptor drum according to the electrostatic latent image formed on the surface. Thus, the electrostatic latent image is developed into the toner image.

The charging blade is liable to generate frictional heat due to friction between the rotating developing roller and the charging blade. Therefore, the toner is liable to fuse and adhere to the charging blade due to the frictional heat, so that a formed image is liable to suffer from an imaging failure which is referred to as white streaking.

More specifically, if the toner fuses and adheres to a portion of an edge of the charging blade kept in press contact with the developing roller, the developing roller is liable to have a linear surface portion not formed with the toner layer at a position corresponding to the toner adhering edge portion of the charging blade during the rotation of the developing roller. The surface portion of the developing roller not formed with the toner layer results in a white streak on the formed image.

Various measures have been proposed for prevention of the white streaking.

Patent Literature 1 (JP-2001-255737A), for example, proposes that at least a part of the charging blade kept in press contact with the surface of the developing roller is formed of a lower rebound material to reduce the friction for the prevention of the fusion/adhesion of the toner to the charging blade and the prevention of the associated white streaking.

Patent Literature 2 (JP-2008-145885A) proposes that the range of the rubber hardness of the developing roller, a linear abutment load to be applied to the developing roller by the charging blade and other factors are each properly limited for the prevention of the fusion/adhesion of the toner to the charging blade and the prevention of the associated white streaking.

Similarly, Patent Literature 3 (JP-2000-338776A) contemplates that the range of the rubber hardness of the developing roller, a linear abutment load to be applied to the developing roller by the charging blade and other factors are each properly limited to stabilize a developing ability and a cleaning ability in a cleaning-free image forming process.

Patent Literature 4 (JP-2007-164082A) proposes that three types of external additives having different properties are used for coating toner particles for the prevention of the fusion/adhesion of the toner to the charging blade and the like.

Patent Literature 5 (JP-2009-150949A) proposes that a toner capturing/recovering member for capturing smaller-diameter toner particles more liable to fuse and adhere to the charging blade is provided in a developing device for the prevention of the fusion/adhesion of the toner to the charging blade and the like.

SUMMARY OF THE INVENTION

However, the measures disclosed in Patent Literatures 1 to 5 are not decisive, failing to reliably prevent the fusion/adhesion of the toner to the charging blade and the associated white streaking.

It is an object of the present invention to provide a developing roller which more reliably prevents the fusion/adhesion of the toner to the charging blade and the associated white streaking as compared with the prior art.

The present invention provides a developing roller for use in an electrophotographic image forming apparatus, the developing roller including a roller body having an outer peripheral surface, at least the outer peripheral surface being formed from a rubber composition comprising a base rubber, the base rubber comprising a styrene butadiene rubber in a proportion of not less than 10 mass % and not greater than 70 mass % based on the overall amount of the base rubber, the outer peripheral surface of the rubber body having a surface roughness Ra of not less than 0.78 μm and not greater than 1.8 μm.

According to the present invention, at least the outer peripheral surface of the roller body is formed from the rubber composition which comprises the base rubber comprising the styrene butadiene rubber in the proportion within the aforementioned range, and the surface roughness Ra of the outer peripheral surface is within the aforementioned range. Thus, a torque applied to the developing roller by a charging blade kept in press contact with the developing roller, i.e., friction between the developing roller and the charging blade, is reduced, whereby generation of the frictional heat is suppressed.

This more reliably prevents the fusion/adhesion of the toner to the charging blade due to the frictional heat and the associated white streaking as compared with the prior art.

It is noted that, in Patent Literature 3, the surface roughness Ra of the outer peripheral surface of the roller body of the developing roller is limited within a range of 0.5 to 1.5 μm, which overlaps the range specified in the present invention.

However, it is merely described in Paragraph [0017] of Patent Literature 3 that the roller body is formed from an electrically conductive silicone rubber containing an electrically conductive material such as carbon black. In Patent Literature 3, there is no teaching that the roller body is formed from a rubber composition containing a base rubber containing SBR in a proportion within the aforementioned range to reduce the friction between the roller body and the charging blade for prevention of the fusion/adhesion of the toner and the associated white streaking.

Even if the outer peripheral surface of the roller body formed from the electrically conductive silicone rubber has a surface roughness Ra within the range specified in the present invention, it is impossible to provide the same effect as in the present invention.

It is preferred that the roller body has a single layer structure formed from the rubber composition, and the outer peripheral surface of the roller body is a surface treated by irradiation with ultraviolet radiation having a wavelength of not less than 100 nm and not greater than 400 nm.

With the single layer structure, the overall construction of the developing roller is simplified. In addition, a very thin oxide film, which functions to further reduce the friction between the roller body and the charging blade, is formed in the outer peripheral surface of the roller body by the irradiation with the ultraviolet radiation having the specific wavelength. This advantageously prevents the fusion/adhesion of the toner to the charging blade due to the frictional heat and the associated white streaking.

The outer peripheral surface of the roller body is preferably configured so that a toner to be used for electrophotographic image formation has an adhesive force of not less than 18 nN and not greater than 38 nN with respect to the outer peripheral surface.

Where the toner adhesive force with respect to the outer peripheral surface is not less than 18 nN, the toner adhering to the outer peripheral surface is substantially prevented from being transferred from the outer peripheral surface to the charging blade when the toner layer is formed. This retards the fusion/adhesion of the toner to the charging blade due to the frictional heat and the associated white streaking. Thus, excellent images free from the white streaking can be sequentially formed on a greater number of sheets.

If the toner adhesive force is greater than 38 nN, the toner adhering to the outer peripheral surface is not easily transferred onto the photoreceptor, thereby reducing the image density of a formed image.

The developing roller according to the present invention more reliably prevents the fusion/adhesion of the toner to the charging blade and the associated white streaking as compared with the prior art.

BRIEF DESCRIPTION OF THE DRAWING

FIG. 1 is a perspective view of a developing roller according to one embodiment of the present invention.

DETAILED DESCRIPTION OF PREFERRED EMBODIMENTS

An inventive developing roller includes a roller body. At least an outer peripheral surface of the roller body is formed from a rubber composition containing a base rubber. The base rubber contains a styrene butadiene rubber in a proportion of not less than 10 mass % and not greater than 70 mass % based on the overall amount of the base rubber. The outer peripheral surface of the rubber body has a surface roughness Ra of not less than 0.78 μm and not greater than 1.8 μm.

The surface roughness of the outer peripheral surface of the roller body is limited to the aforementioned range. This is because, if the surface roughness is less than the lower limit or greater than the upper limit, the fusion/adhesion of the toner to a charging blade and the associated white streaking are more liable to occur with increased friction between the developing roller and the charging blade.

With the surface roughness falling within the aforementioned range, on the other hand, the fusion/adhesion of the toner to the charging blade and the associated white streaking can be prevented with reduced friction between the developing roller and the charging blade. This effect is enhanced by the fact that the roller body is formed from the rubber composition containing the base rubber containing the SBR.

For further enhancement of the effect, the surface roughness Ra of the outer peripheral surface of the roller body is preferably not less than 1.32 μm and not greater than 1.64 μm in the aforementioned range.

In the present invention, the surface roughness Ra of the outer peripheral surface of the roller body is defined as the arithmetic mean height of a profile curve (arithmetic mean roughness of a roughness curve) Ra which is specified by the Japanese Industrial Standards JIS B0601:2001 "Geometrical Product Specification (GPS)—Surface texture: Profile method—Terms, definitions and surface texture parameters."

<SBR>

Usable examples of the SBR include various SBRs synthesized by copolymerizing styrene and 1,3-butadiene by any of various polymerization methods such as an emersion polymerization method and a solution polymerization method. The SBRs are classified into an oil extension type to which an extender oil is added for adjustment of the flexibility thereof, and a non-oil extension type to which no extender oil is added, and either of these types is usable.

Further, the SBRs are classified into a higher proportion styrene type, an intermediate proportion styrene type and a lower proportion styrene type depending on the proportion of styrene in the SBR, and any of these types is usable. The physical properties of the roller body can be controlled by changing the proportion of styrene and the crosslinking degree.

These SBRs may be used either alone or in combination.

The proportion of the SBR to be blended is not less than 10 mass % and not greater than 70 mass % based on the overall amount of the base rubber as described above.

If the proportion of the SBR is less than the aforementioned range, it is impossible to provide the effect of reducing the friction between the developing roller and the charging blade to suppress the frictional heat even with the blending of the SBR. Therefore, a formed image is liable to suffer from the imaging failure such as the white streaking due to the fusion/adhesion of the toner.

Further, the proportion of an ionically conductive rubber such as an epichlorohydrin rubber to be blended with the SBR for the base rubber for the formation of the roller body (as will be described later) is relatively increased to excessively reduce the volume resistivity of the roller body. This may prevent formation of a high quality image.

If the proportion of the SBR is greater than the aforementioned range, the processability of the rubber composition is reduced, making it impossible to control the surface roughness Ra of the outer peripheral surface of the roller body within the aforementioned range. Therefore, a formed image is liable to suffer from the imaging failure such as the white streaking due to the fusion/adhesion of the toner.

Where the surface roughness Ra of the outer peripheral surface of the roller body is not less than 1.32 μm and less than 1.52 μm in the aforementioned range, the proportion of the SBR is preferably not greater than 30 mass %, particularly preferably not greater than 20 mass %, in order to further advantageously prevent the fusion/adhesion of the toner and the associated white streaking.

Where the surface roughness Ra is not less than 1.52 μm and less than 1.64 μm, the proportion of the SBR is preferably not less than 20 mass % and not greater than 70 mass % in the aforementioned range.

<Other Base Rubber Material>

An ionically conductive rubber may be blended with the SBR for the base rubber for the formation of the roller body. By blending the ionically conductive rubber, the roller body is imparted with ion conductivity to control the roller resistance in a proper range. Thus, the tonner can be electrically charged to a proper charge level in a development process.

That is, when the developing roller including the roller body is rotated with the charging blade kept in press contact with the developing roller, the toner can be electrically charged to a charge level suitable for developing an electrostatic latent image on a surface of a photoreceptor drum.

One example of the ionically conductive rubber is an epichlorohydrin rubber.

(Epichlorohydrin Rubber)

Various types of polymers containing epichlorohydrin as a repetitive unit are usable as the epichlorohydrin rubber.

Specific examples of the epichlorohydrin rubber include epichlorohydrin homopolymers, epichlorohydrin-ethylene oxide bipolymers, epichlorohydrin-propylene oxide bipolymers, epichlorohydrin-allyl glycidyl ether bipolymers, epichlorohydrin-ethylene oxide-allyl glycidyl ether terpolymers, epichlorohydrin-propylene oxide-allyl glycidyl ether terpolymers and epichlorohydrin-ethylene oxide-propylene oxide-allyl glycidyl ether quaterpolymers, which may be used either alone or in combination.

Particularly, the epichlorohydrin rubber is preferably an epichlorohydrin copolymer containing ethylene oxide, and the proportion of the ethylene oxide in the copolymer is preferably 30 to 95 mol %, more preferably 55 to 95 mol %, particularly preferably 60 to 80 mol %.

Ethylene oxide functions to reduce the electrical resistance. If the proportion of ethylene oxide is less than the aforementioned range, the electrical resistance reducing effect is reduced. If the proportion of ethylene oxide is greater than the aforementioned range, on the other hand, ethylene oxide is liable to be crystallized, so that the segment motion of molecular chains is prevented to adversely increase the electrical resistance. Further, the roller body is liable to have an increased hardness after being subjected to crosslinking, and the rubber composition is liable to have an increased viscosity when being heated to be melted before the crosslinking.

It is particularly preferred to use any of the epichlorohydrin-ethylene oxide bipolymers (ECO) as the epichlorohydrin rubber.

In the ECO, ethylene oxide is preferably present in a proportion of 30 to 80 mol %, particularly preferably 50 to 80 mol %, and epichlorohydrin is preferably present in a proportion of 20 to 70 mol %, particularly preferably 20 to 50 mol %.

It is also possible to use any of the epichlorohydrin-ethylene oxide-allyl glycidyl ether terpolymers (GECO) as the epichlorohydrin rubber.

In the GECO, ethylene oxide is preferably present in a proportion of 30 to 95 mol %, particularly preferably 60 to 80 mol %, and epichlorohydrin is preferably present in a proportion of 4.5 to 65 mol %, particularly preferably 15 to 40 mol %. Further, allyl glycidyl ether is preferably present in a proportion of 0.5 to 10 mol %, particularly preferably 2 to 6 mol %.

In addition to narrowly-defined GECO copolymers obtained by copolymerizing the aforementioned three types of monomers, copolymers obtained by modifying the epichlorohydrin-ethylene oxide copolymers (ECO) with allyl glycidyl ether are known as the GECO. In the present invention, any of these copolymers are also usable.

The proportion of the epichlorohydrin rubber to be blended is preferably not less than 5 mass % and not greater than 40 mass % based on the overall amount of the base rubber.

If the proportion of the epichlorohydrin rubber is less than the aforementioned range, the roller body is liable to have an increased roller resistance and, hence, provide a reduced toner charge level when being used as the developing roller.

If the proportion of the epichlorohydrin rubber is greater than the aforementioned range, the roller body promotes the adhesion of the toner thereon when being used as the developing roller, resulting in reduction in the image density of a formed image.

(Polar Rubber)

The roller resistance of the roller body can be finely controlled by blending a polar rubber with the SBR and the ionically conductive rubber for the base rubber. Examples of the polar rubber include chloroprene rubbers (CR), nitrile rubbers (NBR), butadiene rubbers (BR) and acryl rubbers (ACM), which may be used either alone or in combination. Particularly, the chloroprene rubbers are preferred.

The proportion of the polar rubber to be blended is a balance obtained by subtracting the proportions of the SBR and the ionically conductive rubber from the overall amount. The proportion of the polar rubber to be blended is determined so that the total amount of the SBR, the ionically conductive rubber and the polar rubber is 100 mass %.

<Crosslinking Component>

A crosslinking agent, an accelerating agent and an acceleration assisting agent are blended as a crosslinking component in the rubber composition for crosslinking the base rubber.

Examples of the crosslinking agent include sulfur crosslinking agents, thiourea crosslinking agents, triazine derivative crosslinking agents, peroxide crosslinking agents and various monomers, which may be used either alone or in combination.

Examples of sulfur crosslinking agents include sulfur powder and organic sulfur-containing compounds. Examples of the organic sulfur-containing compounds include tetramethylthiuram disulfide and N,N-dithiobismorpholine.

Examples of the thiourea crosslinking agents include tetramethylthiourea, trimethylthiourea, ethylene thiourea, and thioureas represented by $(C_nH_{2n+1}NH)_2C{=}S$ (wherein n is an integer of 1 to 10).

Examples of the peroxide crosslinking agents include benzoyl peroxide and the like.

Depending on the type of the crosslinking agent, the accelerating agent and the acceleration assisting agent may be blended in the rubber composition.

Examples of the accelerating agent include inorganic accelerating agents such as lime, magnesia (MgO) and litharge (PbO), and the following organic accelerating agents, which may be used either alone or in combination.

Examples of the organic accelerating agents include: guanidine accelerating agents such as 1,3-di-o-tolylguanidine, 1,3-diphenylguanidine, 1-o-tolylbiguanidine and a di-o-tolylguanidine salt of dicatechol borate; thiazole accelerating agents such as 2-mercaptobenzothiazole and di-2-benzothiazolyl disulfide; sulfenamide accelerating agents such as N-cyclohexyl-2-benzothiazylsulfenamide; thiuram accelerating agents such as tetramethylthiuram monosulfide, tetramethylthiuram disulfide, tetraethylthiuram disulfide and dipentamethylenethiuram tetrasulfide; and thiourea accelerating agents, which may be used either alone or in combination.

Different types of accelerating agents have different functions and, therefore, are preferably used in combination.

Examples of the acceleration assisting agent include: metal compounds such as zinc white; fatty acids such as stearic acid, oleic acid and cotton seed fatty acids; and other conventionally known acceleration assisting agents, which may be used either alone or in combination.

The proportions of the crosslinking agent, the accelerating agent and the acceleration assisting agent to be blended are properly determined according to the proportions of the SBR and other rubbers blended as the base rubber, and the types and combination of the crosslinking agent, the accelerating agent and acceleration assisting agent.

<Electrically Conductive Carbon Black>

The roller body may be imparted with electrical conductivity by blending electrically conductive carbon black in the rubber composition. If an excessively great amount of the electrically conductive carbon black is blended, however, the roller body is liable to have an uneven roller resistance with significant variations. Therefore, the proportion of the electrically conductive carbon black is preferably not less than 1 part by mass and not greater than 5 parts by mass, particularly preferably not greater than 3 parts by mass, based on 100 parts by mass of the base rubber.

<Other Components>

As required, an acid accepting agent, a filler and the like may be blended in the rubber composition.

In the presence of the acid accepting agent, chlorine-containing gases generated from the epichlorohydrin rubber during the crosslinking of the base rubber is prevented from remaining in the roller body. Thus, the acid accepting agent functions to prevent the inhibition of the crosslinking and the contamination of the photoreceptor, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where any of the hydrotalcites is used in combination with magnesium oxide or potassium oxide, a higher acid accepting effect can be provided, thereby more advantageously preventing the contamination of the photoreceptor.

The proportion of the acid accepting agent to be blended is preferably not less than 0.2 parts by mass and not greater than 10 parts by mass, particularly preferably not less than 1 part by mass and not greater than 5 parts by mass, based on 100 parts by mass of the base rubber.

If the proportion of the acid accepting agent is less than the aforementioned range, the effect described above may be insufficient even with the blending of the acid accepting agent. If the proportion of the acid accepting agent is greater than the aforementioned range, the roller body is liable to have an increased hardness after the crosslinking.

Examples of the filler include zinc oxide, silica, carbon, carbon black, clay, talc, calcium carbonate, magnesium carbonate, aluminum hydroxide and titanium oxide, which may be used either alone or in combination.

The blending of the filler makes it possible to properly control the rubber hardness of the roller body and to improve the mechanical strength of the roller body.

The proportion of the filler to be blended is preferably not greater than 50 parts by mass, particularly preferably not greater than 10 parts by mass, based on 100 parts by mass of the base rubber.

The rubber composition containing the aforementioned ingredients can be prepared in a conventional manner. First, the rubber ingredients for the base rubber are blended in the predetermined proportions, and the resulting base rubber is simply kneaded. After additives other than the crosslinking component are added to and kneaded with the base rubber, the crosslinking component is added to and further kneaded with the resulting mixture. Thus, the rubber composition is provided. A kneader, a Banbury mixer, an extruder or the like, for example, is usable for the kneading.

<Developing Roller>

FIG. 1 is a perspective view of a developing roller according to one embodiment of the present invention.

Referring to FIG. 1, the developing roller 1 includes a cylindrical roller body 2 formed from the aforementioned rubber composition, and a shaft 4 inserted through a center hole 3 of the roller body 2.

The roller body 2 may be non-porous or may be porous.

The roller body 2 may have a double layer structure including an outer layer adjacent to an outer peripheral surface 5, and an inner layer adjacent to the shaft 4. In this case, at least the outer layer may be formed from the rubber composition.

However, the roller body 2 preferably basically has a single layer structure formed from the aforementioned rubber composition as shown in FIG. 1 in order to simplify the construction of the developing roller 1 for production of the developing roller 1 at improved productivity at lower costs.

The shaft 4 is a unitary member made of a metal such as aluminum, an aluminum alloy or a stainless steel. The roller body 2 and the shaft 4 are bonded to each other, for example, with an electrically conductive adhesive agent for electrical connection as well as mechanical connection and, therefore, are unitarily rotatable.

As described above, the surface roughness Ra of the outer peripheral surface 5 of the roller body 2 is controlled in the range of not less than 0.78 μm and not greater than 1.8 μm, for example, by polishing the outer peripheral surface 5 under properly controlled polishing conditions as in the conventional manner.

The outer peripheral surface 5 of the roller body 2 may be formed with an oxide film 6 as indicated on a greater scale in FIG. 1.

The formation of the oxide film 6 further reduces the friction, because the oxide film 6 serves as a lower friction layer. This advantageously prevents the fusion/adhesion of the toner to the charging blade which may otherwise occur due to the frictional heat, and prevents the associated white streaking.

Further, the oxide film 6 functions as a dielectric layer to reduce the dielectric dissipation factor of the developing roller 1.

As described above, the oxide film 6 is formed by the irradiation of the outer peripheral surface 5 of the roller body 2 with the ultraviolet radiation. This method is advantageous, which ensures easy and efficient formation of the oxide film 6. The formation of the oxide film 6 in the outer peripheral surface 5 is achieved, for example, by irradiating the outer peripheral surface 5 of the roller body 2 with ultraviolet radiation having a predetermined wavelength for a predetermined period of time.

Since the rubber composition which forms the outer peripheral surface 5 of the roller body is oxidized by the irradiation with the ultraviolet radiation to form the oxide film 6, there is no possibility that the surface roughness Ra of the outer peripheral surface 5 is changed by the formation of the oxide film 6.

The wavelength of the ultraviolet radiation for the irradiation is preferably not less than 100 nm and not greater than 400 nm, particularly preferably not greater than 300 nm, for the formation of the oxide film 6 having the excellent functions described above. Further, the irradiation period is preferably not shorter than 30 seconds and not longer than 30 minutes, particularly preferably not shorter than 1 minute and not longer than 15 minutes.

The oxide film 6 may be formed by other method, and may be obviated in some case.

The outer peripheral surface 5 of the roller body 2 of the developing roller 1 is preferably configured so that the toner to be used for the image formation has an adhesive force of not less than 18 nN and not greater than 38 nN with respect to the outer peripheral surface 5.

Where the toner adhesive force with respect to the outer peripheral surface 5 is not less than 18 nN, the toner adhering to the outer peripheral surface 5 is substantially prevented from being transferred from the outer peripheral surface 5 to the charging blade when the toner layer is formed. This retards the fusion/adhesion of the toner to the charging blade due to the frictional heat and the associated white streaking. Thus, excellent images free from the white streaking can be sequentially formed on a greater number of sheets. Therefore, the inventive developing roller can be incorporated in an image forming apparatus having a longer service life.

If the toner adhesive force is greater than 38 nN, the toner adhering to the outer peripheral surface is not easily transferred onto the photoreceptor, thereby reducing the image density of a formed image.

The toner adhesive force is preferably not less than 23 nN, particularly preferably not less than 30 nN in the aforementioned range, in order to ensure that excellent images free from the white streaking can be sequentially formed on the greatest possible number of sheets.

In order to control the toner adhesive force with respect to the outer peripheral surface 5 within the aforementioned range, it is effective, for example, to increase the proportion of the SBR within the aforementioned range and to increase the surface roughness Ra of the outer peripheral surface 5 within the aforementioned range. Where the oxide film 6 is formed in the outer peripheral surface 5 of the roller body 2 by the irradiation with the ultraviolet radiation, it is particularly preferred to reduce the irradiation period as much as possible.

As apparent from the results of measurement in Examples to be described later, the toner adhesive force with respect to the outer peripheral surface 5 is controlled to not less than 30 nN by reducing the total period of the irradiation of the outer peripheral surface 5 with the ultraviolet radiation from 20 minutes to not longer than 10 minutes, whereby excellent images free from the white streaking and other imaging failure can be sequentially formed on 8000 sheets.

In the present invention, the toner adhesive force with respect to the outer peripheral surface is expressed by a measurement value obtained by a measurement method using a centrifugal adhesive force analyzer (Model NS-C200 available from Nano Seeds Corporation).

The developing roller 1 can be produced in the conventional manner by employing the rubber composition containing the ingredients described above.

That is, the rubber composition is heated to be melted while being kneaded by means of an extruder. The melted rubber composition is extruded into an elongated hollow cylindrical shape through a die conformal to the sectional shape (annular sectional shape) of the roller body 2.

Then, the extruded rubber composition is cooled to be solidified, and then the resulting product is heated to be vulcanized in a vulcanization can with a temporary vulcanization shaft inserted through a hole 3 thereof.

In turn, the resulting product is removed from the temporary shaft, and fitted around a shaft 4 having an outer peripheral surface to which an electrically conductive adhesive agent is applied. Where the adhesive agent is a thermosetting adhesive agent, the thermosetting adhesive agent is thermally cured to electrically connect the roller body 2 to the shaft 4 and mechanically fix the roller body 2 to the shaft 4.

As required, the outer peripheral surface 5 of the roller body 2 is polished to the predetermined surface roughness and then, as required, oxidized by the irradiation with the ultraviolet radiation to form the oxide film 6 covering the outer peripheral surface 5. Thus, the developing roller 1 shown in FIG. 1 is produced.

The developing roller is advantageously used in combination with a charging blade for developing an electrostatic latent image formed on a surface of a photoreceptor drum into a toner image in an electrophotographic image forming apparatus such as a laser printer, an electrostatic copying machine, a plain paper facsimile machine or a printer-copier-facsimile multifunction machine.

EXAMPLES

Example 1

Preparation of Rubber Composition

First, 10 parts by mass of SBR (JSR1502 available from JSR Co., Ltd.), 20 parts by mass of ECO (EPICHLOMER (registered trade name) D available from Daiso Co., Ltd.) and 70 parts by mass of CR (SHOPRENE (registered trade name) WRT available from Showa Denko K.K.) were blended to prepare a base rubber. The proportion of the SBR in the base rubber was 10 mass %.

While 100 parts by mass of the base rubber was simply kneaded by a Banbury mixer, ingredients shown below in Table 1 except for a crosslinking component were added to and kneaded with the base rubber. Finally, the crosslinking component was added to and kneaded with the resulting mixture. Thus, a rubber composition was prepared.

TABLE 1

| Ingredients | Parts by mass |
|---|---|
| Ethylene thiourea | 0.5 |
| 5% oil-containing sulfur | 1.2 |
| Accelerating agent DT | 0.43 |
| Accelerating agent DM | 0.2 |
| Accelerating agent TS | 0.5 |
| Zinc white | 5 |
| Electrically conductive carbon black | 2 |
| Hydrotalcites | 3 |

The ingredients shown in Table 1 will be detailed below:

Ethylene thiourea: Crosslinking agent available under ACCEL (registered trade name) 22-S from Kawaguchi Chemical Industry Co., Ltd.

5% Oil-containing sulfur: Crosslinking agent available from Tsurumi Chemical Industry Co., Ltd.

Accelerating agent DT: 1,3-Di-o-tolylguanidine available under NOCCELER (registered trade name) DT from Ouchi Shinko Chemical Industrial Co., Ltd.

Accelerating agent DM: Di-2-benzothiazolyl disulfide available under NOCCELER DM from Ouchi Shinko Chemical Industrial Co., Ltd.

Accelerating agent TS: Tetramethylthiuram monosulfide available under NOCCELER TS from Ouchi Shinko Chemical Industrial Co., Ltd.

Zinc white: Acceleration assisting agent available under ZINC OXIDE TYPE-2 from Mitsui Mining & Smelting Co., Ltd.

Electrically conductive carbon black: Available under DENKA BLACK (registered trade name) from Denki Kagaku Kogyo K.K.

Hydrotalcites: Acid accepting agent available under DHT-4A (registered trade name) 2 from Kyowa Chemical Industry Co., Ltd.

The amounts (parts by mass) of the ingredients shown in Table 1 are based on 100 parts by mass of the base rubber.

(Production of Developing Roller)

The rubber composition was fed into an extruder and then extruded into a hollow cylindrical shape having an outer diameter of 20.0 mm and an inner diameter of 7.0 mm. Then, the resulting cylindrical body was fitted around a temporary crosslinking shaft, and crosslinked at 160° C. for 1 hour in a vulcanization can.

Subsequently, the cylindrical body was removed from the temporary shaft, then fitted around a shaft having an outer diameter of 7.5 mm and an outer peripheral surface to which an electrically conductive thermosetting adhesive agent was applied, and heated to 160° C. in an oven. Thus, the cylindrical body was fixed to the shaft. Thereafter, opposite end portions of the cylindrical body were trimmed, and the cylindrical body was polished by a traverse polishing process utilizing a cylindrical polisher and then by a mirror polishing process to be thereby finished as having an outer diameter of 16.00 mm (with a tolerance of 0.05). Thus, a roller body combined with the shaft was produced.

The outer peripheral surface of the roller body had a surface roughness Ra of 1.32 μm as determined based on a measurement result obtained by using a super-deep full-color 3D profile measurement microscope (VK-9510 available from Keyence Corporation).

Subsequently, the outer peripheral surface of the polished roller body was rinsed with water, and the roller body was set in a UV irradiation apparatus (PL21-200 available from Sen Lights Corporation) with its outer peripheral surface spaced 10 cm from a UV lamp. Then, the roller body was rotated about the shaft by 90 degrees at each time, while being irradiated with ultraviolet radiation at wavelengths of 184.9 nm and 253.7 nm. The irradiation with the ultraviolet radiation was carried out for 5 minutes after each rotation, i.e., for a total period of 20 minutes. Thus, an oxide film was formed in the outer peripheral surface of the roller body. In this manner, a developing roller was produced.

Example 2

A developing roller was produced in substantially the same manner as in Example 1, except that 20 parts by mass of SBR, 20 parts by mass of ECO and 60 parts by mass of CR were used. The proportion of the SBR based on the overall amount of the base rubber was 20 mass %. The outer peripheral surface of the roller body had a surface roughness Ra of 1.32 μm, which was the same as in Example 1.

Example 3

A developing roller was produced in substantially the same manner as in Example 1, except that 30 parts by mass of SBR, 20 parts by mass of ECO and 50 parts by mass of CR were used. The proportion of the SBR based on the overall amount of the base rubber was 30 mass %. The outer peripheral surface of the roller body had a surface roughness Ra of 1.32 μm, which was the same as in Example 1.

Example 4

A developing roller was produced in substantially the same manner as in Example 1, except that 50 parts by mass of SBR, 20 parts by mass of ECO and 30 parts by mass of CR were used. The proportion of the SBR based on the overall amount of the base rubber was 50 mass %. The outer peripheral surface of the roller body had a surface roughness Ra of 1.32 μm, which was the same as in Example 1.

Example 5

A developing roller was produced in substantially the same manner as in Example 1, except that 70 parts by mass of SBR, 20 parts by mass of ECO and 10 parts by mass of CR were used. The proportion of the SBR based on the overall amount of the base rubber was 70 mass %. The outer peripheral surface of the roller body had a surface roughness Ra of 1.32 μm, which was the same as in Example 1.

Comparative Example 1

A developing roller was produced in substantially the same manner as in Example 1, except that 5 parts by mass of SBR, 45 parts by mass of ECO and 50 parts by mass of CR were used. The proportion of the SBR based on the overall amount of the base rubber was 5 mass %. The outer peripheral surface of the roller body had a surface roughness Ra of 1.32 μm, which was the same as in Example 1.

Comparative Example 2

A developing roller was produced in substantially the same manner as in Example 1, except that 80 parts by mass of SBR, 10 parts by mass of ECO and 10 parts by mass of CR were used. The proportion of the SBR based on the overall amount of the base rubber was 80 mass %. The outer peripheral surface of the roller body had a surface roughness Ra of 1.32 μm, which was the same as in Example 1.

Example 6

A developing roller was produced in substantially the same manner as in Example 1, except that the outer peripheral surface of the roller body was polished as having a surface roughness Ra of 0.78 μm by changing the polishing conditions. The proportion of the SBR based on the overall amount of the base rubber was 10 mass %.

Example 7

A developing roller was produced in substantially the same manner as in Example 1, except that 20 parts by mass of SBR, 20 parts by mass of ECO and 60 parts by mass of CR were used and the outer peripheral surface of the roller body was polished as having a surface roughness Ra of 1.52 μm by changing the polishing conditions. The proportion of the SBR based on the overall amount of the base rubber was 20 mass %.

Example 8

A developing roller was produced in substantially the same manner as in Example 1, except that 30 parts by mass of SBR, 20 parts by mass of ECO and 50 parts by mass of CR were used and the outer peripheral surface of the roller body was polished as having a surface roughness Ra of 1.64 μm by changing the polishing conditions. The proportion of the SBR based on the overall amount of the base rubber was 30 mass %.

Example 9

A developing roller was produced in substantially the same manner as in Example 1, except that 50 parts by mass of SBR, 20 parts by mass of ECO and 30 parts by mass of CR were used and the outer peripheral surface of the roller body was polished as having a surface roughness Ra of 1.80 μm by changing the polishing conditions. The proportion of the SBR based on the overall amount of the base rubber was 50 mass %.

Example 10

A developing roller was produced in substantially the same manner as in Example 1, except that 70 parts by mass of SBR, 20 parts by mass of ECO and 10 parts by mass of CR were used and the outer peripheral surface of the roller body was polished as having a surface roughness Ra of 1.62 μm by changing the polishing conditions. The proportion of the SBR based on the overall amount of the base rubber was 70 mass %.

Example 11

A developing roller was produced in substantially the same manner as in Example 1, except that 70 parts by mass of SBR, 20 parts by mass of ECO and 10 parts by mass of CR were used and the outer peripheral surface of the roller body was polished as having a surface roughness Ra of 1.80 μm by changing the polishing conditions. The proportion of the SBR based on the overall amount of the base rubber was 70 mass %.

Comparative Example 3

A developing roller was produced in substantially the same manner as in Example 1, except that 5 parts by mass of SBR, 30 parts by mass of ECO and 65 parts by mass of CR were used and the outer peripheral surface of the roller body was polished as having a surface roughness Ra of 0.70 μm by changing the polishing conditions. The proportion of the SBR based on the overall amount of the base rubber was 5 mass %.

Comparative Example 4

A developing roller was produced in substantially the same manner as in Example 1, except that 80 parts by mass of SBR, 10 parts by mass of ECO and 10 parts by mass of CR were used and the outer peripheral surface of the roller body was polished as having a surface roughness Ra of 1.90 μm by changing the polishing conditions. The proportion of the SBR based on the overall amount of the base rubber was 80 mass %.

Example 12

A developing roller was produced in substantially the same manner as in Example 2, except that the irradiation of the outer peripheral surface 5 with the ultraviolet radiation was carried out for 3 minutes and 45 seconds after each 90-degree rotation, i.e., for a total period of 15 minutes. The proportion of the SBR based on the overall amount of the base rubber was 20 mass %. The outer peripheral surface of the roller body had a surface roughness Ra of 1.32 μm, which was the same as in Example 1.

Example 13

A developing roller was produced in substantially the same manner as in Example 2, except that the irradiation of the outer peripheral surface 5 with the ultraviolet radiation was carried out for 2 minutes and 30 seconds after each 90-degree rotation, i.e., for a total period of 10 minutes. The proportion of the SBR based on the overall amount of the base rubber was 20 masse. The outer peripheral surface of the roller body had a surface roughness Ra of 1.32 μm, which was the same as in Example 1.

Example 14

A developing roller was produced in substantially the same manner as in Example 2, except that the irradiation of the outer peripheral surface 5 with the ultraviolet radiation was carried out for 1 minute and 15 seconds after each 90-degree rotation, i.e., for a total period of 5 minutes. The proportion of the SBR based on the overall amount of the base rubber was 20 mass %. The outer peripheral surface of the roller body had a surface roughness Ra of 1.32 μm, which was the same as in Example 1.

Example 15

A developing roller was produced in substantially the same manner as in Example 2, except that the irradiation of the outer peripheral surface 5 with the ultraviolet radiation was carried out for 15 seconds after each 90-degree rotation, i.e., for a total period of 1 minute. The proportion of the SBR based on the overall amount of the base rubber was 20 mass %. The outer peripheral surface of the roller body had a surface roughness Ra of 1.32 μm, which was the same as in Example 1.

<Evaluation for Resistance to White Streaking>

The developing rollers produced in Examples and Comparative Examples were each incorporated in a laser printer (HL-2240D available from Brother Industries, Ltd.) and black solid images were sequentially printed by the printer. Then, the number of images printed until the white streaking occurred due to the fusion/adhesion of toner to a charging blade was recorded. The developing rollers were evaluated for the resistance to the white streaking based on the following six criteria:

AA: White streaking did not occur until 8000 images were printed.

A: White streaking did not occur until 4000 images were printed.

B: White streaking occurred when 3000 images were printed.

C: White streaking occurred when 2000 images were printed.

D: White streaking occurred when 1000 images were printed.

E: White streaking occurred when 100 images were printed.

Developing rollers rated as AA to C were acceptable.

<Measurement of Toner Adhesive Force>

(Preparation of Sample)

A rectangular test strip having a size of 5 mm×5 mm and having a surface defined by the outer peripheral surface of the roller body was cut out from the roller body of each of the developing rollers produced in Examples and Comparative Examples, and bonded onto a metal plate with the outer peripheral surface facing up. Thus, a sample was prepared for measurement of an adhesive force.

(Measurement of Adhesive Force)

A centrifugal adhesive force analyzer (Model NS-C200 available from Nano Seeds Corporation) including an image analyzing section and a centrifuging section was used for the measurement. About 300 particles of a toner for use in the laser printer (HL-2240D available from Brother Industries, Ltd.) were spread on the surface of the sample (the outer peripheral surface of the roller body). This state was defined as an initial state. The amount (number) of the toner particles adhering to the surface of the sample in the initial state was accurately counted through image analysis in the image analyzing section of the analyzer.

Subsequently, the sample in the initial state was set in a standard holder of the centrifugal adhesive force analyzer, and the holder was set in a rotor of the centrifuging section of the analyzer. The sample was subjected to a centrifuging process performed at five levels at predetermined rotation speeds. Then, the amount (number) of toner particles remaining on the surface of the sample after the centrifuging process was counted through the image analysis in the image analyzing section.

Based on the results of the above measurement, a rotation angular speed w which was observed when 50% of the toner particles on the surface of the sample in the initial state were removed from the surface of the sample and 50% of the toner particles remained on the surface of the sample was determined. Based on the rotation angular speed ω thus determined, a toner adhesive force $F_{50}$ (nN) with respect to the outer peripheral surface of the roller body of each of the developing rollers of Examples and Comparative Examples was calculated from the following expression:

$$F_{50}=(\pi/6)\times\rho\times d^3\times r\times\omega^2 \quad (1)$$

wherein ρ is the absolute specific gravity of the toner, d is the average diameter of the toner particles, r is the rotation radius of the sample set in the rotor of the centrifuging section during the centrifuging process.

The results of the evaluation and the measurement are shown in Tables 2 to 4.

TABLE 2

| | | Comparative Example 1 | Example 1 | Example 2 | Example 3 | Example 4 | Example 5 | Comparative Example 2 |
|---|---|---|---|---|---|---|---|---|
| Amounts | SBR | 5 | 10 | 20 | 30 | 50 | 70 | 80 |
| (parts by mass) | ECO | 45 | 20 | 20 | 20 | 20 | 20 | 10 |
| | CR | 50 | 70 | 60 | 50 | 30 | 10 | 10 |
| Proportion of SBR (mass %) | | 5 | 10 | 20 | 30 | 50 | 70 | 80 |
| Surface roughness Ra (μm) | | 1.32 | 1.32 | 1.32 | 1.32 | 1.32 | 1.32 | 1.32 |
| UV irradiation period (min) | | 20 | 20 | 20 | 20 | 20 | 20 | 20 |
| Toner adhesive force $F_{50}$ (nN) | | 15 | 23 | 24 | 22 | 19 | 20 | 22 |
| White streaking | | D | A | A | B | C | C | D |

TABLE 3

| | | Comparative Example 3 | Example 6 | Example 7 | Example 8 | Example 9 | Example 10 | Example 11 | Comparative Example 4 |
|---|---|---|---|---|---|---|---|---|---|
| Amounts | SBR | 5 | 10 | 20 | 30 | 50 | 70 | 70 | 80 |
| (parts by mass) | ECO | 30 | 20 | 20 | 20 | 20 | 20 | 20 | 10 |
| | CR | 65 | 70 | 60 | 50 | 30 | 10 | 10 | 10 |
| Proportion of SBR (mass %) | | 5 | 10 | 20 | 30 | 50 | 70 | 70 | 80 |
| Surface roughness Ra (μm) | | 0.70 | 0.78 | 1.52 | 1.64 | 1.80 | 1.62 | 1.80 | 1.90 |
| UV irradiation period (min) | | 20 | 20 | 20 | 20 | 20 | 20 | 20 | 20 |
| Toner adhesive force $F_{50}$ (nN) | | 14 | 18 | 23 | 24 | 19 | 24 | 20 | 25 |
| White streaking | | E | C | A | A | C | A | C | E |

TABLE 4

| | | Example 12 | Example 13 | Example 14 | Example 15 |
|---|---|---|---|---|---|
| Amounts | SBR | 20 | 20 | 20 | 20 |
| (parts by mass) | ECO | 20 | 20 | 20 | 20 |
| | CR | 60 | 60 | 60 | 30 |
| Proportion of SBR (mass %) | | 20 | 20 | 20 | 20 |
| Surface roughness Ra (μm) | | 1.32 | 1.32 | 1.32 | 1.32 |
| UV irradiation period (min) | | 15 | 10 | 5 | 1 |
| Toner adhesive force $F_{50}$ (nN) | | 25 | 30 | 35 | 38 |
| White streaking | | A | AA | AA | AA |

The results of Examples and Comparative Examples shown in Tables 2 to 4 indicate that the surface roughness Ra of the outer peripheral surface of the roller body should be not less than 0.78 μm and not greater than 1.8 μm and the proportion of the SBR in the base rubber of the roller body should be not less than 10 mass % and not greater than 70 mass % for the prevention of the white streaking.

The results of Examples 1 to 15 indicate that the surface roughness Ra is preferably not less than 1.32 μm and not greater than 1.64 μm in the aforementioned range for more reliably preventing the white streaking.

The results of Examples 1 to 5 indicate that, where the surface roughness Ra is not less than 1.32 μm and less than 1.52 μm in the aforementioned range, the proportion of the SBR is preferably not greater than 30 mass %, particularly preferably not greater than 20 mass %, in the aforementioned range.

The results of Examples 6 to 11 indicate that, where the surface roughness Ra is not less than 1.52 μm and not greater than 1.64 μm in the aforementioned range, the proportion of SBR is preferably not less than 20 mass % and not greater than 70 mass % in the aforementioned range.

The results of Examples 2 and 12 to 15 indicate that the toner adhesive force $F_{50}$ with respect to the outer peripheral surface of the roller body is preferably not less than 18 nN and not greater than 38 nN, more preferably not less than 23 nN, particularly preferably not less than 30 nN, in order to ensure that excellent images free from the white streaking can be sequentially formed on the greatest possible number of sheets, and the total period of the irradiation of the outer peripheral surface 5 with the ultraviolet radiation is preferably reduced from 20 minutes to not longer than 10 minutes.

While the present invention has been described in detail by way of the embodiments thereof, it should be understood that these embodiments are merely illustrative of the technical principles of the present invention but not limitative of the invention. The spirit and scope of the present invention are to be limited only by the appended claims.

This application corresponds to Japanese Patent Application No. 2011-180882 filed in the Japan Patent Office on Aug. 22, 2011 and Japanese Patent Application No. 2011-258012 filed in the Japan Patent Office on Nov. 25, 2011, the disclosures of which are incorporated herein by reference in its entirety.

What is claimed is:

1. A developing roller for use in an electrophotographic image forming apparatus, the developing roller comprising:

a roller body having an outer peripheral surface, at least the outer peripheral surface being formed from a rubber composition comprising a styrene butadiene rubber, an ionically conductive rubber and a polar rubber as a base rubber, the base rubber comprising the styrene butadiene rubber in a proportion of not less than 10 mass % and not greater than 20 mass % based on an overall amount of the base rubber, the outer peripheral surface of the roller body having a surface roughness Ra of not less than 1.32 μm and less than 1.52 μm, wherein the outer peripheral surface of the roller body is configured so that a toner to be used for electrophotographic image formation has an adhesive force of not less than 23 nN with respect to the outer peripheral surface.

2. The developing roller according to claim 1, wherein the roller body has a single layer structure formed from the rubber composition, and the outer peripheral surface of the roller body is a surface treated by irradiation with ultraviolet radiation having a wavelength of not less than 100 nm and not greater than 400 nm.

3. The developing roller according to claim 1, wherein the outer peripheral surface of the roller body is configured so that a toner to be used for electrophotographic image formation has an adhesive force of not greater than 38 nN with respect to the outer peripheral surface.

4. The developing roller according to claim 1, wherein the base rubber comprises an epichlorohydrin rubber as the ionically conductive rubber in a proportion of not less than 5 mass % and not greater than 40 mass % based on an overall amount of the base rubber.

5. The developing roller according to claim 4, wherein the base rubber comprises a chloroprene rubber as the polar rubber, and the proportion of the chloroprene rubber to be blended is a balance obtained by subtracting the proportions of the SBR and the epichlorohydrin rubber from the overall amount.

6. A developing roller for use in an electrophotographic image forming apparatus, the developing roller comprising:

a roller body having an outer peripheral surface, at least the outer peripheral surface being formed from a rubber composition comprising a styrene butadiene rubber, an ionically conductive rubber and a polar rubber as a base rubber, the base rubber comprising the styrene butadiene rubber in a proportion of not less than 20 mass % and not greater than 70 mass % based on an overall amount of the base rubber, the outer peripheral surface of the roller body having a surface roughness Ra of not less than 1.52 μm and not greater than 1.64 μm, wherein the outer peripheral surface of the roller body is configured so that a toner to be used for electrophotographic image formation has an adhesive force of not less than 23 nN with respect to the outer peripheral surface.

7. The developing roller according to claim 6, wherein the roller body has a single layer structure formed from the rubber composition, and the outer peripheral surface of the roller body is a surface treated by irradiation with ultraviolet radiation having a wavelength of not less than 100 nm and not greater than 400 nm.

8. The developing roller according to claim 6, wherein the outer peripheral surface of the roller body is configured so that a toner to be used for electrophotographic image formation has an adhesive force of not greater than 38 nN with respect to the outer peripheral surface.

9. The developing roller according to claim 6, wherein the base rubber comprises an epichlorohydrin rubber as the ionically conductive rubber in a proportion of not less than 5 mass % and not greater than 40 mass % based on an overall amount of the base rubber.

10. The developing roller according to claim 9, wherein the base rubber comprises a chloroprene rubber as the polar rubber, and the proportion of the chloroprene rubber to be blended is a balance obtained by subtracting the proportions of the SBR and the epichlorohydrin rubber from the overall amount.

* * * * *